US009803266B2

(12) United States Patent
Kobayashi et al.

(10) Patent No.: US 9,803,266 B2
(45) Date of Patent: Oct. 31, 2017

(54) HIGH-STRENGTH HOT-ROLLED STEEL SHEET AND METHOD FOR PRODUCING THE SAME

(71) Applicant: NIPPON STEEL & SUMITOMO METAL CORPORATION, Tokyo (JP)

(72) Inventors: Yukiko Kobayashi, Tokyo (JP); Eisaku Sakurada, Tokyo (JP); Kunio Hayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 343 days.

(21) Appl. No.: 14/405,227

(22) PCT Filed: Jun. 24, 2013

(86) PCT No.: PCT/JP2013/067229
§ 371 (c)(1),
(2) Date: Dec. 3, 2014

(87) PCT Pub. No.: WO2014/002941
PCT Pub. Date: Jan. 3, 2014

(65) Prior Publication Data

US 2015/0159244 A1 Jun. 11, 2015

(30) Foreign Application Priority Data

Jun. 26, 2012 (JP) ..... 2012-142692

(51) Int. Cl.
*C22C 38/02* (2006.01)
*C22C 38/04* (2006.01)
(Continued)

(52) U.S. Cl.
CPC ..... *C22C 38/14* (2013.01); *C21D 8/0263* (2013.01); *C21D 8/0463* (2013.01); *C21D 9/46* (2013.01);
(Continued)

(58) Field of Classification Search
None
See application file for complete search history.

(56) References Cited

U.S. PATENT DOCUMENTS 9,222,155 B2 * 12/2015 Nakamura ..... C21D 8/0226
2013/0087254 A1 4/2013 Funakawa et al.
2014/0007993 A1 1/2014 Nakajima et al.

FOREIGN PATENT DOCUMENTS

EP 2453032 A1 5/2012
JP 10-36917 A 2/1998
(Continued)

OTHER PUBLICATIONS

Extended European Search Report for European Application No. 13809684.7, dated Feb. 16, 2016.
(Continued)

*Primary Examiner* — Deborah Yee
(74) *Attorney, Agent, or Firm* — Birch, Stewart, Kolasch & Birch, LLP

(57) ABSTRACT

Provided is a high-strength hot-rolled steel sheet containing, by mass %, C: 0.050 to 0.200%, Si: 0.01 to 1.5%, Mn: 1.0 to 3.0%, B: 0.0002 to 0.0030%, Ti: 0.03 to 0.20%, P: limited to 0.05% or less, S: limited to 0.005% or less, Al: limited to 0.5% or less, N: limited to 0.009% or less, and one or more of Nb: 0.01 to 0.20%, V: 0.01 to 0.20%, and Mo: 0.01 to 0.20%, with the balance being composed of Fe and inevitable impurities. In the high-strength hot-rolled steel sheet, a ratio of a length of small-angle crystal grain boundaries that are boundaries having a crystal orientation angle of 5° or more but less than 15° to a length of large-angle crystal grain boundaries that are boundaries having a crystal orientation angle of 15° or more is 1:1 to 1:4, an total segregation amount of C and B in the large-angle grain boundaries is 4
(Continued)

to 20 atoms/nm$^2$, tensile strength is 850 MPa or higher, and a hole expansion ratio is 25% or more.

4 Claims, 2 Drawing Sheets

(51) Int. Cl.

| | |
|---|---|
| ***C22C 38/06*** | (2006.01) |
| ***C22C 38/26*** | (2006.01) |
| ***C22C 38/28*** | (2006.01) |
| ***C22C 38/32*** | (2006.01) |
| ***C21D 8/02*** | (2006.01) |
| ***C21D 9/46*** | (2006.01) |
| ***C22C 38/14*** | (2006.01) |
| ***C22C 38/00*** | (2006.01) |
| ***C22C 38/12*** | (2006.01) |
| ***C21D 8/04*** | (2006.01) |
| ***C21D 9/48*** | (2006.01) |

(52) U.S. Cl.
CPC ..... *C21D 9/48* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C21D 2201/05* (2013.01); *C21D 2211/004* (2013.01)

(56) References Cited

FOREIGN PATENT DOCUMENTS

| | | | |
|---|---|---|---|
| JP | 2001-172745 | A | 6/2001 |
| JP | 2004-315857 | A | 11/2004 |
| JP | 2005-298924 | A | 10/2005 |
| JP | 2006-274335 | A | 10/2006 |
| JP | 2008-261029 | A | 10/2008 |
| JP | 2008-266726 | A | 11/2008 |
| JP | 2012-1776 | A | 1/2012 |
| TW | 201209180 | A | 3/2012 |
| WO | WO 2012/036308 | A1 | 3/2012 |

OTHER PUBLICATIONS

International Search Report, dated Sep. 17, 2013, issued in PCT/JP2013/067229.
Taiwanese Office Action 102122541 dated Jul. 18, 2014.
Takahashi et al., "Quantitative Observation of Grain Boundary Carbon Segregation in Bake Hardening Steels", Nippon Steel Technical Report, No. 381, Oct. (2004), pp. 26-30.
Written Opinion of the International Searching Authority, dated Sep. 17, 2013, issued in PCT/JP2013/067229.

* cited by examiner (a)

(b)

HIGH-STRENGTH HOT-ROLLED STEEL SHEET AND METHOD FOR PRODUCING THE SAME

TECHNICAL FIELD

The present invention relates to a hot-rolled steel sheet which is subjected to burring work or stretch flanging work, for example, suitable for high-strength structural parts of an automobile or the like and hardly has a damage occurrence in an end face at the time of punching of the steel sheet and a method for producing the same. This application is based upon and claims the benefit of priority from the prior Japanese Patent Application No. 2012-142692, filed on Jun. 26, 2012, the entire contents of which are incorporated herein by reference.

BACKGROUND ART

In recent years, there is a tendency that weight reduction of automotive members is emphasized from the viewpoint of energy saving and safety and durability thereof are also additionally emphasized, and thus higher strengthening is rapidly progressing than ever before. As an example of this tendency, a high-strength steel sheet is adapted to be applied not only to outer panels of an automobile but also to structural members.

The steel sheet to be applied to such structural members also requires workability such as hole expandability in addition to press formability. For this reason, a high-strength hot-rolled steel sheet having excellent workability in a burring work, a stretch flanging work or the like has been developed (for example, see Patent Literatures 1 and 2).

However, with the higher strength of the hot-rolled steel sheet, there is a problem that peeling or burr-like defects occur in an end face of a hole formed by a punching work of the steel sheet. These defects significantly impair a design nature in the end face of the product and also have a risk of affecting fatigue strength or the like as a stress concentration portion.

With respect to the above problems, a hot-rolled steel sheet has been proposed in which an area ratio of a second hard phase and cementite is restricted and the damage is suppressed in the punched end face (for example, see Patent Literatures 3 and 4). However, even though the formation of the second hard phase and cementite is suppressed, when a clearance of the punching work is set to the most severe condition to the damage of the end face, there are cases where the defects occur in the end face of the hole.

In contrast, a high-strength hot-rolled steel sheet has been developed in which B is added or the adding amount of P is limited so as to suppress a fracture in crystal grain boundaries during working and thus the damage occurrence in the punched end face is suppressed (see Patent Literatures 5 and 6). Furthermore, a high-strength hot-rolled steel sheet has been developed in which the segregation amount of C or C and B is controlled in large-angle crystal grain boundaries of ferrite and thus the damage occurrence in the punched end face can be prevented even when the punching work is carried out under the most severe conditions (see Patent Literatures 7 and 8). However, the steel sheets disclosed in Patent Literatures 5 to 8 include a structure mainly containing a ferrite phase. Accordingly, these steel sheets were difficult to achieve high strength of 850 MPa or higher.

PRIOR ART LITERATURES

Patent Literatures

[Patent Literature 1] JP H10-36917A
[Patent Literature 2] JP 2001-172745A
[Patent Literature 3] JP 2004-315857A
[Patent Literature 4] JP 2005-298924A
[Patent Literature 5] JP 2004-315857A
[Patent Literature 6] JP 2005-298924A
[Patent Literature 7] JP 2008-261029A
[Patent Literature 8] JP 2008-266726A

SUMMARY OF THE INVENTION

Problems to be Solved by the Invention

The invention has been made to solve the above problems and an object of the invention is to provide a high-strength hot-rolled steel sheet which achieves both excellent stretch flange formability and ductility, in particular, high strength of tensile strength of 850 MPa or higher and has excellent punching workability which can prevent damage in an end face even when punching work is carried out under the most severe conditions.

Means for Solving the Problems

The inventors have investigated on correlations among the frequency of damage occurrence in the punched end face, kinds of elements segregated in crystal grain boundaries, and the segregation amount in the crystal grain boundaries by setting a clearance of punching work to the most severe condition. As a result, the inventors found using mainly a bainite structure that the damage of the punched end face was reduced when a ratio of large-angle crystal grain boundaries in which a grain boundary angle of the steel sheet is 15° or more to small-angle crystal grain boundaries in which the grain boundary angle is 5° or more but less than 15° was controlled within a proper range and the appropriate amount of C and B was segregated in the large-angle crystal grain boundaries.

The invention has been made based on novel findings, and the gist of the invention is as follows:

[1]

A high-strength hot-rolled steel sheet including, by mass %,

C: 0.050 to 0.200%;
Si: 0.01 to 1.5%;
Mn: 1.0 to 3.0%;
B: 0.0002 to 0.0030%;
Ti: 0.03 to 0.20%;
P: limited to 0.05% or less;
S: limited to 0.005% or less;
Al: limited to 0.5% or less;
N: limited to 0.009% or less; and
one or more of Nb: 0.01 to 0.20%, V: 0.01 to 0.20%, and Mo: 0.01 to 0.20%, with the balance being composed of Fe and inevitable impurities, wherein a ratio of a length of small-angle crystal grain boundaries that are boundaries having a crystal orientation angle of 5° or more but less than 15° to a length of large-angle crystal grain boundaries that are boundaries having a crystal orientation angle of 15° or more is 1:1 to 1:4, a total segregation amount of C and B in the large-angle grain boundaries is 4 to 20 atoms/nm$^2$, tensile strength is 850 MPa or higher, and a hole expansion ratio is 25% or more.

[2]

The high-strength hot-rolled steel sheet according to [1], wherein the content of P is limited to 0.02% or less by mass %, the content of P is limited to 0.02% or less by mass % and the segregation amount of P in the large-angle grain boundaries is 1 atoms/nm$^2$ or less.

[3]

A method for producing a high-strength hot-rolled steel sheet, the method including:

with respect to a steel slab containing by mass %,

C: 0.050 to 0.200%,

Si: 0.01 to 1.5%,

Mn: 1.0 to 3.0%,

B: 0.0002 to 0.0030%,

Ti: 0.03 to 0.20%,

P: limited to 0.05% or less,

S: limited to 0.005% or less,

Al: limited to 0.5% or less,

N: limited to 0.009% or less, and one or more of Nb: 0.01 to 0.20%, V: 0.01 to 0.20%, and Mo: 0.01 to 0.20%, with the balance being composed of Fe and inevitable impurities, heating the steel slab to 1200° C. or higher;

completing finish rolling at a temperature of 910° C. or higher;

performing air cooling for 0.5 to 7 seconds after completing the finish rolling;

subjecting to primary cooling up to a temperature of 550 to 450° C. at a cooling rate of 40° C./s or more;

subjecting to holding or air cooling at a temperature that is not higher than a stop temperature of the primary cooling but not lower than 450° C. for 7.5 to 30 seconds;

subsequently subjecting to secondary cooling up to a temperature of 200° C. or lower at a cooling rate of 15° C./s or more; and subjecting to coiling.

[4]

The method for producing the high-strength hot-rolled steel sheet according to [3], wherein the content of P is limited to 0.02% or less, by mass %, in the steel slab.

Effects of the Invention

According to the invention, a high-strength hot-rolled steel sheet is provided which achieves a good balance between stretch flange formability and ductility, in particular, high strength of tensile strength of at least 850 MPa, and has excellent punching workability in which a damage occurrence in an end face is suppressed regardless of conditions of a clearance of punching work. The invention remarkably contributes to the industry.

MODES FOR CARRYING OUT THE INVENTION

Figure 1:
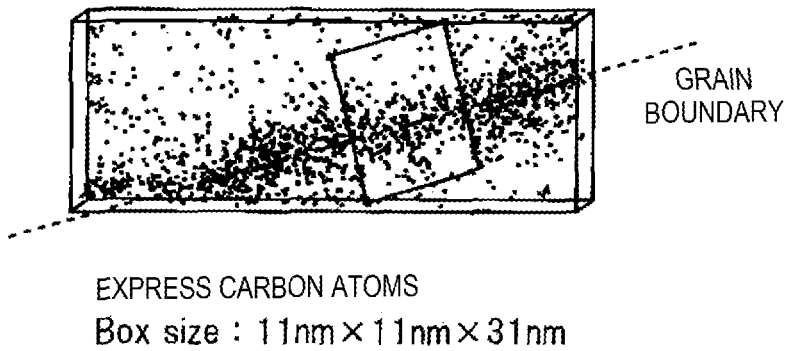
FIG. 1 is a diagram illustrating an example of a three-dimensional atomic distribution image (a) at a position of crystal grain boundaries and a ladder chart analysis (b) which are obtained by a three-dimensional atom probe measuring method.
Figure 1:
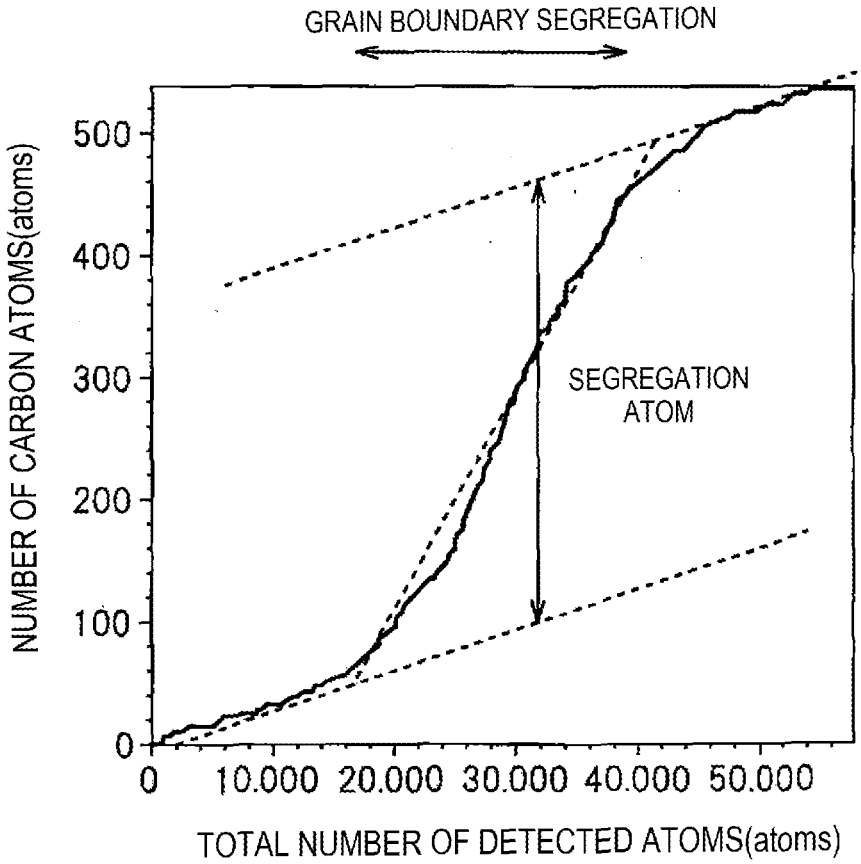

The inventors carried out a punching work in various clearances using a high-strength hot-rolled steel sheet having tensile strength of 850 MPa or higher with excellent ductility and hole expandability to quantitatively examine end face properties thereof.

Specifically, a hole of 10 mm diameter was punched by varying the clearance in accordance with a hole expanding test method disclosed in Japan Iron and Steel Federation Standard JFS T 1001-1996, and a damage occurrence rate in an entire circumference of a punched end face (referred to as a damage occurrence rate in a punched end face) was obtained by dividing a value calculated by measuring and adding up angles in a range to be visually regarded as the damage among the entire circumference of the end face punched into a round-shape, by 360°.

As a result, when the clearance was increased, peeling or burr-like damage occurred which was not confirmed in the case of being punched with the clearance of about 12.5% recommended by a general hole expanding test method. Therefore, it was found that the clearance of 16% was the most severe condition.

Here, the following examination was carried out with the clearance of 16%.

Next, with respect to an influence of a structure on punching workability of a steel sheet and further the frequency of a damage occurrence in the punched end face, that is, correlations among the damage occurrence rate in the punched end face, kinds and amounts of elements segregated in large-angle crystal grain boundaries, and the ratio of small-angle crystal grain boundaries to large-angle crystal grain boundaries, the investigation was carried out. Further, in the invention, the large-angle crystal grain boundaries are defined as a grain boundary at which an angle difference between crystal orientations of crystal grains adjacent to each other is 15° or more. Furthermore, in the invention, the small-angle crystal grain boundary is defined as a grain boundary at which an angle difference between crystal orientations of crystal grains adjacent to each other is 5° or more but less than 15°.

A slab containing, by mass %, C: 0.050 to 0.200%, Si: 0.01 to 1.5%, Mn: 1.0 to 3.0%, B: 0.0002 to 0.0030%, Ti: 0.03 to 0.20%, P: limited to 0.05% or less, S: limited to 0.005% or less, Al: limited to 0.5% or less, N: limited to 0.009% or less, and one or more of Nb: 0.01 to 0.20%, V: 0.01 to 0.20%, and Mo: 0.01 to 0.20% with the balance being composed of Fe and inevitable impurities was melted and was subjected to hot rolling to produce a steel sheet under various heat treatment conditions.

No. 5 test piece of JIS Z 2201 was sampled from the steel sheet and tensile characteristics were evaluated in conformity with JIS Z 2241. In addition, a hole expanding test was carried out according to a test method disclosed in Japan Iron and Steel Federation Standard JFS T 1001-1996 and stretch flange formability of the steel sheet was evaluated. Further, the damage occurrence rate in the punched end face was evaluated after the punching work and before the hole expanding test.

Next, amounts of B, C, and P segregated in five or more points of large-angle crystal grain boundaries in individual steel were measured to obtain an average value.

In order to actively utilize bainite, the steel sheet of the invention includes the small-angle crystal grain boundaries having an angle less than 15° in addition to the large-angle crystal grain boundaries. In the small-angle crystal grain boundaries, there was a tendency that the segregation amount was reduced from the difference in the number of trap sites of the segregated elements compared to the large-angle crystal grain boundaries. However, since the correlation in the segregation amount between the small-angle crystal grain boundaries and the large-angle crystal grain boundaries was recognized, the segregation amount in the large-angle crystal grain boundaries was here measured. An angle of the crystal orientation was determined by analyzing a Kikuchi pattern obtained from a transmission electron microscope observation of the sample.

In the invention, a structure mainly containing the bainite preferably contains the bainite in which an area ratio exceeds 50% when the end face is observed and may contain ferrite or a second phase less than 50%.

As for a method of measuring the amounts of segregation elements, in order to strictly compare a distribution of the segregation elements in the micro region, it is suitable to obtain the Excess amounts using a three-dimensional atom probe method as described below. That is, the crystal grain boundary portion of the sample to be measured is subjected to cutting and electropolishing to prepare an acicular sample. Further, at this time, a focused ion-beam processing method may be utilized together with electropolishing. A region including the crystal grain boundaries and an angle of the grain boundary are observed in a relatively wide visual field by FIM, and the three-dimensional atom probe measurement is carried out.

In the three-dimensional atom probe measurement, integrated data can be reconstructed to obtain an actual distribution image of atoms in a real space. Since an atomic surface is discontinuous at the position of the grain boundaries, the position of the grain boundaries can be recognized as a grain boundary surface and it can be visually observed that various elements are segregated in the position of the grain boundaries.

Next, in order to estimate the segregation amount of each element, a ladder chart was obtained by vertically cutting out in a cuboid shape with respect to the crystal grain boundaries from an atomic distribution image including the crystal grain boundaries. An observation example of the crystal grain boundaries and an example of the ladder chart analysis are illustrated in (a) and (b) of FIG. 1, respectively.

From the ladder chart analysis, the segregation amount of each atom is segregated. That is, the segregation amount of each atom was estimated using an Excess amount represented by an additional number of atoms per unit area of the grain boundaries from a solid solution amount. This estimation referred to "Quantitative Observation of Grain Boundary Carbon Segregation in Bake Hardening Steels", Nippon Steel Technical Report, No. 381, October (2004): p. 26-30 by Takahashi et al.

In addition, the crystal grain boundaries was originally a surface, but used a length as an indicator which was estimated in the following manner in the invention.

The sample, which was cut out to obtain the end face parallel to a rolling direction and a sheet thickness direction of the steel sheet, was polished and was further electropolished. Subsequently, an EBSP measurement was carried out using an Electron Back Scatter Diffraction Pattern-Orientation Imaging Microscopy (EBSP-OIM™) method under measurement conditions of a magnification of 2000 times, an area of 40 μm×80 μm, and a measurement step of 0.1 μm.

The EBSP-OIM™ method is constituted by a device and a software that a highly inclined sample in a scanning electron microscope (SEM) is irradiated with electron beams, a Kikuchi pattern formed by backscattering is photographed by a high-sensitive camera, and an image thereof is processed by a computer, thereby measuring a crystal orientation of an irradiation point for a short time period.

In the EBSP measurement, it is possible to quantitatively analyze a crystal orientation of a bulk sample surface, and an analysis area is an area which can be observed by the SEM. It is possible to observe crystal orientation distributions within the sample by performing measurement over several hours and mapping the area to be analyzed with several tens of thousands of points in a grid shape at regular intervals.

From the measurement result, an area in which an orientation difference between the crystal grains was not less than 15° appeared on a line, this area was recognized as a large-angle crystal grain boundary, and a length of the large-angle crystal grain boundaries was obtained by software. Similarly, an area in which the orientation difference between the crystal grains was 5° or more but less than 15° was recognized as a small-angle crystal grain boundary and a length of the small-angle crystal grain boundaries was obtained by software.

Figure 2:
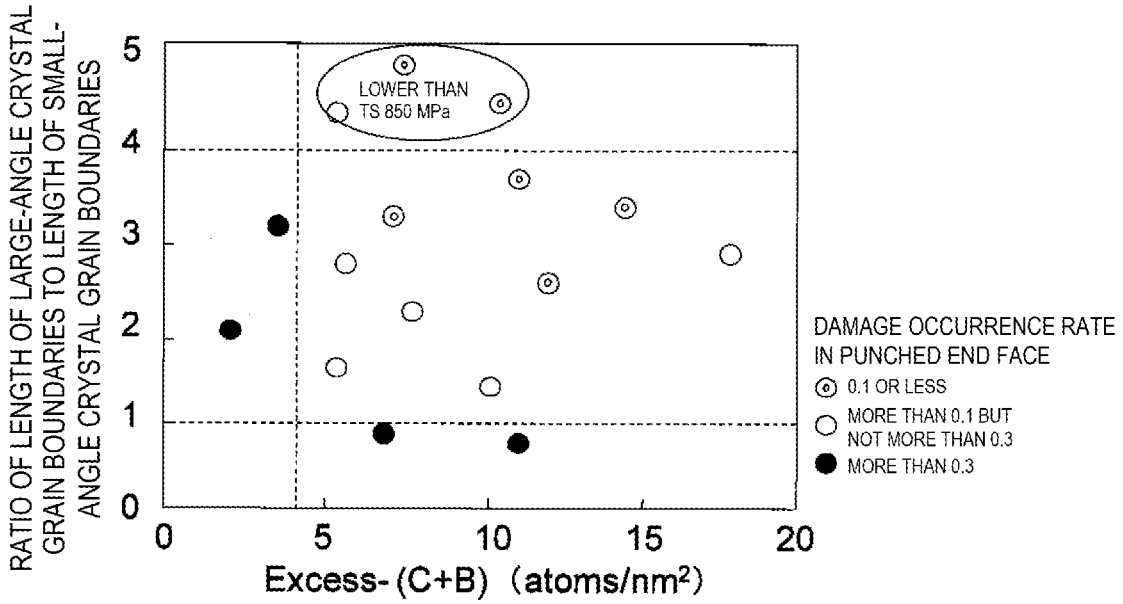
FIG. 2 is a diagram illustrating correlations among a segregation amount of C, a ratio of a length of large-angle crystal grain boundaries to a length of small-angle crystal grain boundaries, and a damage occurrence rate in a punched end face.

A relation between the total segregation amount of C and B, the ratio of the length of the large-angle crystal grain boundaries to the length of the small-angle crystal grain boundaries, and the damage occurrence rate in the punched end face of the steel is illustrated in FIG. 2.

As illustrated in FIG. 2, it was observed that a large amount of C and B was segregated in the large-angle crystal grain boundaries of the steel sheet in which the damage occurrence rate in the punched end face was small.

In the steel sheet of the invention, it is possible to maintain the total amount of C and B segregated in the grain boundaries within an appropriate range by partially dispersing and precipitating carbides of Ti, Nb, V, and Mo into the crystal grain to ensure a solid solution C in the crystal grain, precipitating nitrides of Ti, Nb, and V to suppress precipitation of BN, and leaving a solid solution B in the crystal grain. Thus, it is possible to maintain excellent resistance to damage of the end face at the time of punching the steel sheet.

As the reason of improving the resistance to damage of the end face of the steel sheet in this way, it is considered that the crystal grain boundaries are strengthened by the segregated C and B and a crack growth is suppressed in the crystal grain boundaries at the time of the punching work.

On the other hand, even if a large amount of C and B was segregated in the large-angle crystal grain boundaries, when the ratio of the length of the large-angle crystal grain boundaries to the length of the small-angle crystal grain boundaries was small, the resistance to damage of the end face was deteriorated at the time of punching the steel sheet. As the reason for this, it is considered to be related to the fact that when the ratio of the length of the large-angle crystal grain boundaries is reduced, a unit of the bainite structure relatively increases, a block grain boundary tends to decrease, and thus toughness is deteriorated. Further, in an area in which the ratio of the length of the large-angle crystal grain boundaries became very large, the damage occurrence rate in the punched end face was suppressed to be low, but the strength was reduced because the structure mainly contained ferrite.

Figure 3:
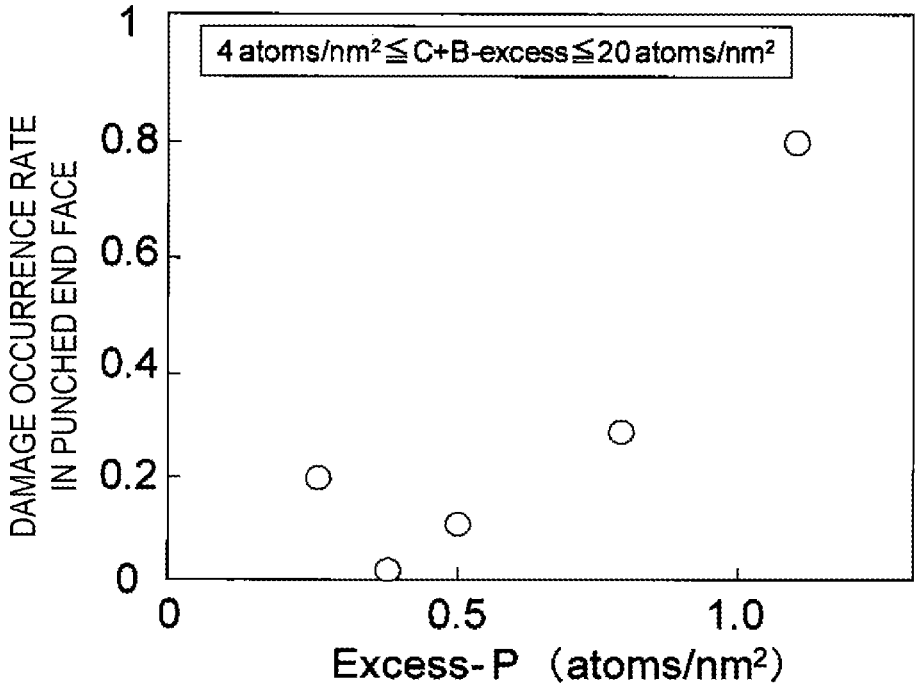
FIG. 3 is a diagram illustrating a correlation between a segregation amount of P and a damage occurrence rate in a punched end face.

In addition, FIG. 3 illustrates a relation between the segregation amount of P and the damage occurrence rate in the punched end face. As illustrated in FIG. 3, in the case of increasing the segregation amount of P by intentionally adding P while maintaining the segregation amount of C and B to a certain amount or more in the crystal grain boundaries, it was found that a punching damage occurrence rate was being increased.

From the above results, it was found that when the carbides and BN were excessively precipitated during cooling after hot rolling, the solid solution C and the solid solution B was reduced, a small amount of C and B was segregated in the grain boundaries, and the damage occurred in the punched end face. Therefore, a method was further examined in which a large amount of C and B was segregated in the large-angle crystal grain boundaries to improve the punching workability, as compared to the normal steel.

Consequently, it was found that when the carbides and BN were suppressed to be precipitated into the crystal grain, the damage of the punched end face was suppressed. On the other hand, unlike C and B, it was found that there were elements to reduce the grain boundary strengthening amount when being segregated in the grain boundaries.

Details of the invention defined in claims are described in the following.

(Segregation Amount)

If the damage occurrence rate in the punched end face is 0.3 or less at the clearance of the most severe condition, the range is allowable as practical steel. In the examination of the invention, the clearance of 16% is the most severe condition, but can be varied due to the material of the steel sheet and a tool. Thus, it is necessary to confirm the most severe clearance condition by performing the punching work while varying the clearance from 12.5% to 25% to confirm the end face properties. In order to make the end face damage to be 0.3 or less in the case of carrying out the punching work of the steel sheet under the most severe clearance condition, it is necessary to optimize the amount of element to be segregated in the grain boundaries of the crystal grain boundaries as described below.

As illustrated in FIG. 2, if the total segregation amount of C and B in the large-angle crystal grain boundaries is 4 atoms/nm$^2$ or more, the damage occurrence rate in the punched end face can be confined to be 0.3 or less when the steel sheet is subjected to the punching work under the most severe clearance condition. If the total segregation amount of C and B is below 4 atoms/nm$^2$, the grain boundary strengthening amount is insufficient and the damage significantly occurs in the punched end face.

Meanwhile, there was no preferred upper limit of the total segregation amount of C and B in the crystal grain boundaries, but it was considered that the upper limit of the amount, which can be substantially segregated in the steel sheet of the invention, was about 20 atoms/nm$^2$. The total segregation amount of C and B in the crystal grain boundaries is more preferably in the range of 6 to 15 atoms/nm$^2$ in which the damage hardly occurs in the punched end face.

Further, in order to prevent the segregation amount of C in the grain boundaries from being reduced by the precipitation of the segregated C as a carbide such as cementite, the steel sheet is rapidly cooled down to 200° C. or lower after a desired segregation is achieved by cooling after hot rolling. Thus, the total segregation amount of C and B can range from 4 to 20 atoms/nm$^2$.

Meanwhile, the segregation amount of P is preferably small. The reason for this is because it is considered that P has an effect of embritting the grain boundaries. In addition, the reason is that the crack growth is facilitated at the time of the punching work and the damage occurrence rate is increased when the segregation amount of P increases. Further, there is also a concern that the segregation amounts of C and B are reduced as P occupies segregation sites. The segregation amount of P is preferably 1 atoms/nm$^2$ or less. In order for the segregation amount of P to be 1 atoms/nm$^2$ or less, the content of P may be limited to 0.02% or less.

(Ratio of Length of Large-Angle Crystal Grain Boundaries to Length of Small-Angle Crystal Grain Boundaries)

As illustrated in FIG. 2, when the total segregation amount of C and B is 4 to 20 atoms/nm$^2$ and further the ratio of the length of the large-angle crystal grain boundaries to the length of the small-angle crystal grain boundaries is 1 or more and 4 or less, the damage occurrence rate in the punched end face can be confined to be 0.3 or less when the steel sheet is subjected to the punching work under the most severe clearance condition. It is considered to be related to the fact that when the ratio of the length of the large-angle crystal grain boundaries to the length of the small-angle crystal grain boundaries is less than 1, a block grain size of bainite tends to increase and toughness is deteriorated thereby increasing the damage occurrence rate in the punched end face. In addition, when the ratio of the length of the large-angle crystal grain boundaries to the length of the small-angle crystal grain boundaries is more than 4, the damage occurrence rate in the punched end face is suppressed to be low, but the strength is reduced because the structure mainly contains ferrite. Thus, in this case, it will not satisfy the steel sheet of the invention having the tensile strength of 850 MPa or higher.

(Composition)

In the invention, the steel sheet is preferably defined to have the following component compositions such that a structure of the steel sheet has the segregation amount in the grain boundaries and the ratio of the length of the large-angle crystal grain boundaries to the length of the small-angle crystal grain boundaries which are described above as the steel sheet composition, the steel sheet has elongation of 15% or more, hole expansion ratio of 25% or more, tensile strength of 850 MPa or higher, and the damage occurrence rate in the punched end face is 0.3 or less when the punching work of the steel sheet is carried out under the most severe clearance condition. Further, "%" to be described below represents "% by mass" values unless otherwise specified.

In addition, the intended effects of the invention are sufficiently exhibited by basic components to be described below, but other components may be contained within the range of not inhibiting the intended properties of the steel sheet of the invention. For example, Cr of less than 0.2% and Cu of less than 0.15% may be contained.

C: C is an element contributing to improve strength, and the content of C is necessary to be 0.050% or more to obtain the structure mainly containing bainite of the invention and sufficiently ensure the segregation amount of C in the grain boundaries. On the other hand, when the content of C exceeds 0.200%, the formation of cementite or the formation of a transformation structure such as pearlite or martensite is unnecessarily promoted, and thus elongation or hole expandability is reduced. Therefore, the content of C is set to be in the range of 0.050 to 0.200%.

B: B is an important element in the invention, and the damage of the punched end face is prevented by the segregation of B even when the segregation of C in the grain boundaries is insufficient. The content of B is necessary to be 0.0002% or more to obtain the above effect. On the other hand, when the content of B exceeds 0.0030%, workability such as ductility is reduced. Accordingly, the content of B is set to be in the range of 0.0002 to 0.0030%.

Si: Si serves as a solid solution strengthening element, which is effective for improvement of the strength. The content of Si is necessary to be 0.01% or more to obtain such an effect. On the other hand, when the content of Si exceeds 1.5%, the workability is deteriorated. Accordingly, the content of Si is set to be in the range of 0.01 to 1.5%.

Mn: Mn is necessary for deoxidation and desulfurization, which is also effective as a solid solution strengthening element. Further, the content of Mn is necessary to be 1.0% or more to stabilize austenite and easily obtain bainite structure. On the other hand, when the content of Mn exceeds 3.0%, the segregation easily occurs and the workability is deteriorated. Accordingly, the content of Mn is set to be in the range of 1.0 to 3.0%.

Ti: Ti is an element used to precipitate carbides and nitrides into crystal grains of ferrite or bainite and increase the strength of the steel sheet by precipitation strengthening. In order to sufficiently generate the carbides and nitrides, the content of Ti is set to be 0.03% or more. On the other hand, when the content of Ti exceeds 0.20%, the carbides and nitrides become coarse. Accordingly, the content of Ti is set to be in the range of 0.03 to 0.20%.

P: P is an impurity, and the content of P is necessary to be limited to 0.05% or less. In addition, the content of P is preferably limited to 0.02% or less to suppress the segregation of P in the grain boundaries and prevent cracks of the grain boundaries.

Further, in the invention, one or more of V, Nb, and Mo, which are elements used to precipitate the carbides into the crystal grains, may be contained to achieve the high strength of the steel sheet. In order to promote the grain boundary segregation of B, furthermore, one or two kinds of V and Nb as a nitride precipitating element may be preferably contained, thereby suppressing the precipitation of BN.

V and Nb: V and Nb are elements used to precipitate carbides and nitrides into crystal grains of ferrite or bainite and increase the strength of the steel sheet by precipitation strengthening. In order to sufficiently generate the carbides and nitrides, the each content of V and Nb is preferably 0.01% or more. On the other hand, when the each content of V and Nb exceeds 0.20%, the carbides and nitrides may become coarse. Accordingly, the each content of V and Nb is preferably set to be in the range of 0.01 to 0.20%.

Mo: Mo is a carbide forming element and may be contained for the purpose of precipitating the carbides into crystal grains and contributing to precipitation strengthening. In order to sufficiently generate the carbides, the content of Mo is preferably 0.01% or more. On the other hand, when the adding amount of Mo exceeds 0.20%, coarse carbides may be generated. Accordingly, the content of Mo is preferably set to be in the range of 0.01 to 0.20%.

Furthermore, the content of N, S, and Al is preferably limited to the following upper limit.

N: N forms nitrides and reduces the workability of the steel sheet, and thus the content thereof is preferably limited to 0.009% or less.

S: S is present as an inclusion such as MnS and deteriorates stretch flange formability to further cause cracking during hot rolling. Therefore, it is preferable to reduce the content of S as much as possible. Particularly, the content of S is preferably limited to 0.005% or less to prevent the cracking during the hot rolling and to improve the workability.

Al: Al forms precipitates such as nitrides and impairs the workability of the steel sheet, and thus the content thereof is preferably limited to 0.5% or less. Further, Al of 0.002% or more is preferably added for the purpose of deoxidation of molten steel.

In the invention, W as a solid solution strengthening element may be also added for the purpose of improving the strength of the steel sheet, in addition to the above basic components.

(Producing Conditions)

A steel slab obtained by melting and casting the steel consisting of the above component compositions in a conventional manner is subjected to hot rolling. The steel slab is preferably produced in continuous casting equipment from the viewpoint of productivity. A heating temperature of hot rolling is 1200° C. or higher to sufficiently decompose and dissolve carbide forming elements and carbon in steel. When the heating temperature is excessively high, it is not economically preferred. Therefore, the upper limit of the heating temperature is preferably 1300° C. or lower. After the casting, the steel slab is cooled down and may be subjected to initial rolling at a temperature of 1200° C. or higher. In the case of heating the steel slab cooled to 1200° C. or lower, it is preferable to hold for one or more hours.

A finishing temperature of finish rolling in the hot rolling is necessary to be 910° C. or higher to suppress the formation of coarse carbides. The upper limit of the finishing temperature of the finish rolling needs not to be specifically limited in order to obtain the effects of the invention, but is preferably 1000° C. or lower because there is a possibility that scale defects occur at the time of working.

Furthermore, the finish rolling is preferably performed at a total reduction ratio of 60% or more in three stands from a final stand to make crystal grain sizes of austenite fine. The reduction ratio is preferably as high as possible, but the upper limit thereof is substantially 95% from the viewpoint of productivity or equipment loads.

After completing the hot rolling, it is preferable to perform air cooling for 0.5 to 7 seconds. This is because of promoting recrystallization of austenite to easily obtain the structure of the invention mainly containing bainite. When the air cooling is performed for a period below 0.5 seconds, the transformation occurs from non-recrystallized austenite grains, which may lead to the ferrite formation during the cooling. When the air cooling is performed for a period above 7 seconds, TiC precipitation proceeds in the austenite and effective precipitation may become few in the bainite or ferrite.

Subsequently, in order to suppress the precipitation of the carbides in the austenite region, the ferrite transformation, and the pearlite transformation as much as possible, it is necessary that cooling rate of primary cooling is 40° C./s or more and a finishing temperature of the primary cooling ranges from 550° C. or lower to 450° C. or higher.

When the cooling rate of the primary cooling is less than 40° C./s, coarse carbides are precipitated during the cooling, the segregation amount of C in the grain boundaries is reduced, and thus there is a concern that the damage of the punched end face increases. The upper limit of the cooling rate of the primary cooling is not particularly limited, but a reasonable cooling rate is 300° C./s or less in consideration of capacity of cooling equipment. In addition, when the finishing temperature of the primary cooling exceeds 550°

C., the bainite is formed at a high temperature and the ratio of the length of the large-angle crystal grain boundaries is reduced. Moreover, when the finishing temperature exceeds 600° C., the ferrite transformation is promoted and thus the strength is reduced, and the hole expansion ratio is reduced by the formation of pearlite. Meanwhile, when the finishing temperature is lower than 450° C., a large amount of martensite is formed and the hole expansion ratio is reduced.

Subsequently, it is necessary to hold or air-cool from a stop temperature or lower of the primary cooling to a temperature higher than 450° C. for 7.5 seconds or longer to realize a bainite transformation. In the case of a period shorter than 7.5 seconds, the bainite transformation becomes insufficient, a large amount of martensite is formed by subsequent cooling, and the workability is deteriorated. The holding or air cooling period is preferably 10 seconds or longer and more preferably 15 seconds or longer. From the viewpoint of productivity, the air cooling is preferred and the upper limit period of the air cooling is 30 seconds.

Subsequently, secondary cooling is carried out up to a temperature of 200° C. or lower at 15° C./s or more. The reason is that when the temperature higher than 200° C. is held after the bainite transformation, carbides such as cementite are precipitated, C to be segregated becomes insufficient, and thus it is difficult to obtain the segregation amount of C in the grain boundaries according to the invention. The upper limit of the cooling rate of the secondary cooling is not particularly limited, but a reasonable cooling rate is 200° C./s or less in consideration of the capacity of the cooling equipment. In the case of performing coiling after the cooling is carried out from 200° C. or lower to a room temperature or higher, the precipitation of cementite or the like is less likely to occur and C segregated in the large-angle crystal grain boundaries of the bainite is held. More preferably, when the coiling is performed at 100° C. or higher, a solid solution C in the crystal grain may migrate to more stable crystal grain boundaries to increase the segregation amount.

EXAMPLES

Examples of the invention will be described together with Comparative Examples.

Materials having component compositions (the balance is Fe and inevitable impurities) indicated in Table 1 were variously dissolved. Component values indicated in the Table are chemical analysis values, and the unit thereof is mass %. In Table 1, a mark "-" means the case of not being intentionally added.

TABLE 1

| Steel | Chemical composition (mass %) | | | | | | | | | | | |
|---|---|---|---|---|---|---|---|---|---|---|---|---|
| type | C | Si | Mn | P | S | Al | N | Ti | Nb | V | Mo | B |
| A | 0.052 | 1.5 | 2.2 | 0.030 | 0.001 | 0.030 | 0.001 | 0.17 | — | 0.05 | — | 0.0015 |
| B | 0.064 | 0.8 | 2.5 | 0.008 | 0.002 | 0.31 | 0.006 | 0.06 | 0.08 | — | — | 0.0024 |
| C | 0.070 | 1.1 | 2.3 | 0.009 | 0.001 | 0.026 | 0.002 | 0.15 | 0.03 | — | — | 0.0012 |
| D | 0.103 | 0.9 | 1.8 | 0.007 | 0.002 | 0.031 | 0.002 | 0.09 | — | — | 0.1 | 0.0015 |
| E | 0.165 | 0.02 | 1.1 | 0.009 | 0.003 | 0.034 | 0.003 | 0.05 | 0.06 | 0.03 | — | 0.0003 |
| F | 0.069 | 1.2 | 2.4 | 0.055 | 0.001 | 0.025 | 0.002 | 0.16 | — | — | — | 0.0009 |
| G | 0.067 | 1.1 | 2.5 | 0.009 | 0.001 | 0.032 | 0.002 | 0.13 | 0.02 | — | — | 0.0001 |
| H | 0.041 | 0.95 | 1.2 | 0.008 | 0.001 | 0.030 | 0.001 | 0.14 | — | 0.05 | — | 0.001 |

A mark "—" indicates the case of not being intentionally added.

Next, a hot-rolled steel sheet was produced by hot rolling carried out under producing conditions as shown in Table 2. Primary cooling is a cooling to be performed immediately after the completion of the hot rolling, and secondary cooling is a cooling to be performed prior to coiling.

TABLE 2

| | Producing conditions | | | | | | | | | |
|---|---|---|---|---|---|---|---|---|---|---|
| Test No. | Steel type | Heating temperature ° C. | Finishing temperature in hot rolling ° C. | Air-cooling period after hot rolling s | Primary cooling rate ° C./s | Finishing temperature of primary cooling ° C. | Holding or air-cooling period until start of secondary cooling s | Secondary cooling rate ° C./s | Coiling temperature ° C. | Note |
| 1 | A | 1240 | 960 | 2 | 30 | 520 | 20 | 20 | <100 | Comparative Example |
| 2 | A | 1250 | 970 | 0.5 | 50 | 530 | 8 | 15 | 150 | Inventive Example |
| 3 | A | 1230 | 910 | 0.2 | 40 | 540 | 15 | 15 | 130 | Comparative Example |
| 4 | B | 1250 | 970 | 7 | 40 | 550 | 15 | 20 | <100 | Inventive Example |
| 5 | B | 1250 | 970 | 2 | 50 | 350 | 10 | 15 | <100 | Comparative Example |
| 6 | C | 1230 | 950 | 5 | 50 | 520 | 18 | 15 | 350 | Comparative Example |

TABLE 2-continued

| | | Producing conditions | | | | | | | | |
|---|---|---|---|---|---|---|---|---|---|---|
| Test No. | Steel type | Heating temperature ° C. | Finishing temperature in hot rolling ° C. | Air-cooling period after hot rolling s | Primary cooling rate ° C./s | Finishing temperature of primary cooling ° C. | Holding or air-cooling period until start of secondary cooling s | Secondary cooling rate ° C./s | Coiling temperature ° C. | Note |
| 7 | C | 1250 | 960 | 2 | 40 | 550 | 22 | 20 | 140 | Inventive Example |
| 8 | D | 1240 | 960 | 3 | 40 | 640 | 20 | 15 | <100 | Comparative Example |
| 9 | D | 1250 | 930 | 1 | 40 | 500 | 25 | 20 | 130 | Inventive Example |
| 10 | E | 1260 | 970 | 4 | 50 | 550 | 30 | 20 | 180 | Inventive Example |
| 11 | E | 1240 | 950 | 4 | 40 | 600 | 25 | 15 | <100 | Comparative Example |
| 12 | F | 1250 | 960 | 2 | 40 | 520 | 15 | 15 | <100 | Comparative Example |
| 13 | G | 1230 | 950 | 2 | 40 | 530 | 20 | 15 | <100 | Comparative Example |
| 14 | H | 1240 | 950 | 3 | 50 | 550 | 20 | 20 | 150 | Comparative Example |

From these steel sheets, No. 5 test piece disclosed in JIS Z 2201 was worked and tensile characteristics were evaluated in conformity with a test method disclosed in JIS Z 2241. As one of stretch flange formability, a hole expanding test was evaluated according to a test method disclosed in Japan Iron and Steel Federation Standard JFS T 1001-1996. Further, a damage occurrence rate in a punched end face was obtained in such a manner that a hole of 10 mm diameter was punched as in the hole expanding test, the shape of end face was visually observed, and angles in a range to be regarded as the damage was measured among the end faces punched into circle-shapes. In addition, the hole expansion ratio was tested in accordance with a hole expanding test method of a metallic material disclosed in JIS Z 2256, and it was evaluated to pass the test when the hole expansion ratio was 25% or more.

In addition, a columnar sample of 0.3 mm×0.3 mm×10 mm was cut out from the steel sheet, and a purpose grain boundary portion was prepared to have a sharp acicular-shape by electropolishing or focused ion-beam processing method and then was subjected to a three-dimensional atom probe measurement. In order to estimate the segregation amount of each element in the grain boundaries, a ladder chart was obtained by vertically cutting out in a cuboid shape with respect to the grain boundaries from an atomic distribution image including the grain boundaries. From the ladder chart analysis, the segregation amount of each element was estimated using an Excess amount. In individual steel, the segregation amount of each element in five or more grain boundaries was examined to obtain an average value. The obtained average value was set as the segregation amount of each element in the individual steel.

Furthermore, the sample, which was cut out to obtain the end face parallel to a rolling direction and a sheet thickness direction of the steel sheet, was polished and was further electro-polished. Subsequently, an EBSP measurement was performed on the sample using the above-described EBSP-OIM™ method under measurement conditions of a magnification of 2000 times, an area of 40 μm×80 μm, and a measurement step of 0.1 μm. From the measurement result of the individual steel, an area in which an orientation difference between the crystal grains was not less than 15° was recognized as a large-angle crystal grain boundary, an area in which the orientation difference between the crystal grains was not less than 5° and below 15° was recognized as a small-angle crystal grain boundary, and lengths of the large-angle crystal grain boundaries and the small-angle crystal grain boundaries were obtained by software.

Each of test results described above is indicated in Table 3. Next, each of data indicated in Table 3 will be schematically described.

Test Nos. 2, 4, 7, 9, and 10 are examples in which components and producing conditions of the steel sheet are within the scope of the invention, in which the strength is high, hole expandability is excellent, and the damage rate of the punched end face is also small.

Meanwhile, No. 1 is an example in which a cooling rate of the primary cooling is slow and the damage of the punched end face occurs, and No. 6 is an example in which a coiling temperature is high, the total segregation amount of C and B in the grain boundaries is insufficient, and the damage of the punched end face occurs.

No. 5 is an example in which a finishing temperature of the primary cooling is low, a large amount of martensite is formed, and the hole expansion ratio is reduced.

No. 3 is an example in which an air cooling period after the hot rolling is short and the strength is reduced, No. 8 is an example in which the finishing temperature of the primary cooling is high and the strength is reduced, and No. 14 is an example in which the content of C is insufficient and the strength is reduced.

No. 11 is an example in which the finishing temperature of the primary cooling is slightly high, the ratio of the large-angle grain boundaries is reduced, and the damage of the punched end face occurs.

No. 13 is an example in which the content of B is insufficient, the segregation amount in the grain boundaries is not attained, and the damage of the end face occurs during the punching.

No. 12 is an example in which the content of P is large and the damage of the punched end face occurs.

TABLE 3

| Test No. | Steel type | Sample properties: Tensile strength (MPa) | Sample properties: Elongation (%) | Hole expansion ratio (%) | Length of large-angle crystal grain boundaries/ length of small-angle crystal grain boundaries | Segregation amount in grain boundaries (atoms/nm$^2$): C + B | Segregation amount in grain boundaries (atoms/nm$^2$): P | Damage of punched end face Damage rate | Note |
|---|---|---|---|---|---|---|---|---|---|
| 1 | A | 850 | 18 | 51 | 3.0 | 3.6 | 1.1 | 0.5 | Comparative Example |
| 2 | A | 860 | 17 | 42 | 2.6 | 4.8 | 0.6 | 0.3 | Inventive Example |
| 3 | A | 810 | 20 | 65 | 4.8 | 6.6 | 0.7 | 0.2 | Comparative Example |
| 4 | B | 930 | 16 | 55 | 1.3 | 5.6 | 0.3 | 0.2 | Inventive Example |
| 5 | B | 980 | 16 | 24 | 1.5 | 4.2 | 0.3 | 0.3 | Comparative Example |
| 6 | C | 940 | 17 | 40 | 2.4 | 2.9 | 0.4 | 0.8 | Comparative Example |
| 7 | C | 980 | 16 | 42 | 2.1 | 10.8 | 0.4 | 0 | Inventive Example |
| 8 | D | 830 | 19 | 60 | 5.2 | 5.8 | 0.4 | 0.2 | Comparative Example |
| 9 | D | 920 | 17 | 62 | 2.9 | 6.3 | 0.2 | 0.1 | Inventive Example |
| 10 | E | 990 | 15 | 50 | 1.8 | 14.8 | 0.3 | 0.1 | Inventive Example |
| 11 | E | 970 | 16 | 59 | 0.9 | 9.0 | 0.4 | 0.4 | Comparative Example |
| 12 | F | 950 | 15 | 49 | 2.4 | 4.6 | 1.3 | 0.6 | Comparative Example |
| 13 | G | 920 | 17 | 53 | 2.2 | 3.4 | 0.5 | 0.4 | Comparative Example |
| 14 | H | 790 | 21 | 70 | 3.5 | 4.0 | 0.3 | 0.2 | Comparative Example |

The invention claimed is:

1. A high-strength hot-rolled steel sheet comprising: by mass %,

C: 0.050 to 0.200%;
Si: 0.01 to 1.5%;
Mn: 1.0 to 3.0%;
B: 0.0002 to 0.0030%;
Ti: 0.03 to 0.20%;
P: limited to 0.05% or less;
S: limited to 0.005% or less;
Al: limited to 0.5% or less;
N: limited to 0.009% or less; and
one or more of Nb: 0.01 to 0.20%, V: 0.01 to 0.20%, and Mo: 0.01 to 0.20%,
with the balance being composed of Fe and inevitable impurities,
wherein a ratio of a length of small-angle crystal grain boundaries that are boundaries having a crystal orientation angle of 5° or more but less than 15° to a length of large-angle crystal grain boundaries that are boundaries having a crystal orientation angle of 15° or more is 1:1 to 1:4,
a total segregation amount of C and B in the large-angle grain boundaries is 4 to 20 atoms/nm$^2$,
tensile strength is 850 MPa or higher, and
a hole expansion ratio is 25% or more.

2. The high-strength hot-rolled steel sheet according to claim 1, wherein the content of P is limited to 0.02% or less by mass %, and
the segregation amount of P in the large-angle grain boundaries is 1 atoms/nm$^2$ or less.

3. The method for producing a high-strength hot-rolled steel sheet according to claim 1, the method comprising:
with respect to a steel slab containing by mass %,
C: 0.050 to 0.200%,
Si: 0.01 to 1.5%,
Mn: 1.0 to 3.0%,
B: 0.0002 to 0.0030%,
Ti: 0.03 to 0.20%,
P: limited to 0.05% or less,
S: limited to 0.005% or less,
Al: limited to 0.5% or less,
N: limited to 0.009% or less, and
one or more of Nb: 0.01 to 0.20%, V: 0.01 to 0.20%, and Mo: 0.01 to 0.20%,
with the balance being composed of Fe and inevitable impurities,
heating the steel slab to 1200° C. or higher;
completing finish rolling at a temperature of 910° C. or higher;
performing air cooling for 0.5 to 7 seconds after completing the finish rolling;
subjecting to primary cooling up to a temperature of 550 to 450° C. at a cooling rate of 40° C./s or more;
subjecting to holding or air cooling at a temperature that is not higher than a stop temperature of the primary cooling but not lower than 450° C. for 7.5 to 30 seconds;
subsequently subjecting to secondary cooling up to a temperature of 200° C. or lower at a cooling rate of 15° C./s or more; and
subjecting to coiling.

4. The method for producing the high-strength hot-rolled steel sheet according to claim 3, wherein the content of P is limited to 0.02% or less, by mass %, in the steel slab.

* * * * *